US005511627A

United States Patent [19]

Anderson

[11] Patent Number: 5,511,627

[45] Date of Patent: Apr. 30, 1996

[54] DOWNHOLE STABILISER

[76] Inventor: Charles A. Anderson, Sunnyside Farmhouse, Banchory Devenick, Aberdeen AB1 5YD, Scotland

[21] Appl. No.: 244,569

[22] PCT Filed: Dec. 1, 1992

[86] PCT No.: PCT/GB92/02225

§ 371 Date: Jun. 1, 1994

§ 102(e) Date: Jun. 1, 1994

[87] PCT Pub. No.: WO93/11334

PCT Pub. Date: Jun. 10, 1993

[30] Foreign Application Priority Data

Dec. 4, 1991 [GB] United Kingdom ..... 9125778

[51] Int. Cl.[6] ..... E21B 7/08

[52] U.S. Cl. ..... 175/73; 175/325.2

[58] Field of Search ..... 175/61, 73, 325.2

[56] References Cited

U.S. PATENT DOCUMENTS

| | | | |
|---|---|---|---|
| 4,307,786 | 12/1981 | Evans | 175/61 X |
| 4,388,974 | 6/1983 | Jones, Jr. et al. | 175/325.2 |
| 4,416,339 | 11/1983 | Baker et al. | 175/61 |
| 4,637,479 | 1/1987 | Leising | 175/61 X |
| 4,886,130 | 12/1989 | Evans | 175/73 |
| 4,991,667 | 2/1991 | Wilkes, Jr. et al. | 175/61 |
| 5,265,682 | 11/1993 | Russell et al. | 175/61 X |

FOREIGN PATENT DOCUMENTS

| | | | |
|---|---|---|---|
| 0190529 | 8/1986 | European Pat. Off. . | |
| 0251543 | 5/1991 | European Pat. Off. . | |
| 0497422 | 8/1992 | European Pat. Off. . | |
| 120966 | 4/1900 | Germany . | |
| 2121453 | 12/1983 | United Kingdom . | |
| 2259316 | 10/1993 | United Kingdom | 175/73 |

*Primary Examiner*—Hoang C. Dang
*Attorney, Agent, or Firm*—Bell, Seltzer, Park & Gibson

[57] ABSTRACT

There is described a downhole stabilizer (10) for use in a drill string adjacent the drill bit. The stabilizer (10) includes a hollow and generally cylindrical casing (12) the outer surface of which defines three angularly spaced protrusions (24, 26, 28), the radially outer surfaces of which define a diameter which is marginally less than the diameter of the bore to be drilled. Two of the protrusions (24, 26) carry radially extensible and retractable spacer members (42–52) which are interconnected so that radially outward movement of one member (42–46) results in radially inward movement of the other member (48–52) and vice versa, effectively to vary the radial length of the respective protrusions. A control mandrel (56) is mounted within the casing (12) and is selectively movable between first and second positions. The control mandrel (56) further defines abutments (58, 60) for limiting the inward movement of the space members (42–52) and in the first position the mandrel permitting a greater degree of travel of one spacer member (42–46) than the other (48–52), and in a second position providing the opposite. The arrangement is such that, in use, the stabilizer (10) with the mandrel (56) in its first position causes the drill to veer laterally about a generally vertical axis in a first direction and with the mandrel in its second position the drill bit is caused to veer laterally in the opposite direction.

16 Claims, 3 Drawing Sheets

DOWNHOLE STABILISER

Figure 1:
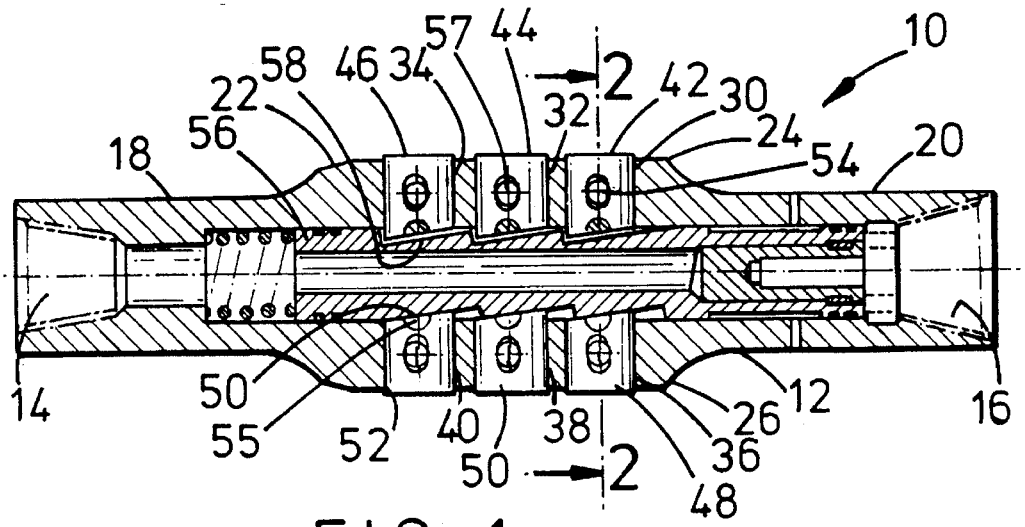

This invention relates to a drilling tool, and in particular to a downhole stabiliser for use in a drill string during directional drilling. The invention also relates to a method of directional drilling.

Boreholes, particularly gas and oil bores, are often drilled to extend downwardly and upwardly; this permits bores to, for example, fan outwardly over a wide area from a single, central drilling location and this arrangement is frequently utilised in offshore drilling operations. The drilling of such inclined bores is achieved through use of drilling tools generally known as stabilisers mounted on the drill string comparatively near the drill bit, such as described in European Patent Specification No. EP-A-0 251 543.

Conventional directional drilling techniques utilise stabilisers of different diameters of stabilisers with variable effective diameters: a maximum diameter equal to the bore will tend to centralise the drill string in a bore which maintains the straightness of the well being drilled, and a lesser diameter will allow at least part of the drill string to bow downwardly under its own weight and thus create an upward curvature of the well.

It is an object of the present invention to provide a drilling tool which further permits bores to be drilled in a desired lateral direction in addition to the choice of upward inclinations available using conventional stabilisers.

According to one aspect of the present invention there is provided a downhole stabiliser for use in a drill string adjacent the drill bit, the stabiliser comprising a hollow and generally cylindrical casing the outer surface of which defines first, second and third angularly spaced protrusions the radially outer surfaces of which define a diameter which is marginally less than the diameter of the bore to be drilled, said first and second protrusions carrying radially extensible and retractable spacer members which are interconnected so that radially outward movement of one member results in radially inward movement of the other member and vice versa, effectively to vary the radial length of the respective protrusions, and a control mandrel mounted within the casing and selectively movable between first and second positions, the control mandrel defining abutment means for limiting the inward movement of the spacer members, in the first position the mandrel permitting a greater degree of travel of one spacer member than the other, and in a second position the mandrel providing the opposite.

The arrangement is such that, in use, the stabiliser with the mandrel in its first position causes the drill bit to veer laterally about a generally vertical axis in a first direction and with the mandrel in its second position the drill bit is caused to veer laterally in the opposite direction.

In use, the stabiliser is utilised on an inclined drill string where bowing of the drill string under its own weight results in the tool being pushed into contact with a lower portion of the bore wall. Thus, with the control mandrel in its first position, once in each revolution of the stabiliser, one spacer member may be pushed inwardly by contact with the lower portion of the bore wall and the other spacer member is thus pushed outwardly to push against a side portion of the bore wall and thus push the stabiliser and adjacent drill bit towards the opposite side of the bore wall. This results in the drill bit tending to drill towards said opposite side of the bore wall to produce a bore which veers laterally to that side. With the control mandrel in the second position the opposite effect is produced to provide a bore hole which veers laterally to the other side of the hole.

To produce a bore which does not veer off in one direction the control mandrel is moved from one position to the other at predetermined intervals to maintain the bore hole substantially straight about a generally vertical axis.

Preferably, the spacer members are in the form of pistons each located in a respective protrusions. Preferably also, the third protrusion is of fixed radial length.

The control mandrel may be locked in the respective positions by appropriate means and is preferably locked in the first position relative to the body by a locking piston mounted in the fixed length protrusion and in the second position by pressure applied to the control mandrel by drilling mud. The drilling mud pressure may tend to move the mandrel in one direction against a spring, and such movement may be restrained by the locking piston to hold the mandrel in the first position. However, if the stabiliser is rotated prior to the application of drilling mud pressure centrifugal force will move the locking piston to a retracted position. If the drilling mud pressure is then applied the mandrel is free to move to the second position.

The protrusions are preferably angularly spaced by between 90° and 180°, and most preferably equi-angularly spaced by 120°. Further, a plurality of sets of axially spaced spacer members are provided, the preferred arrangement having three sets of two members, that is each of the first and second protrusions having three longitudinally spaced spacer members. The protrusions may extend longitudinally or spirally along the casing.

According to another aspect of the present invention there is provided a downhole stabiliser for use in a drill string adjacent a drill bit, the stabiliser comprising: a casing including two circumferentially spaced spacer members selectively actuable to be radially extended from the casing on each rotation of the drill string, as the tool is rotated through a selected angular orientation relative to the bore being drilled, to bear against a portion of the wall of the bore being drilled and move the stabiliser and drill string in a selected lateral direction towards an opposite portion of bore wall and thus cause the drill bit to drill the bore in said selected lateral direction, actuation of one member resulting in the bore veering in one direction, and actuation of the other member resulting in the bore veering in the opposite direction.

According to a further aspect of the present invention there is provided a directional drilling method comprising the steps of:

providing a stabiliser on a drill string adjacent the drill bit;

locating the drill string in an inclined bore and rotating the drill string; and during each rotation of the drill string selectively extending one of two members from the stabiliser as the string rotates through a selected angular orientation to bear against a side portion of bore wall and push the stabiliser and drill bit in a selected direction towards an opposite side portion of the bore wall, the movement tending to cause the drill bit to laterally turn the bore towards said selected direction.

Figure 2A:
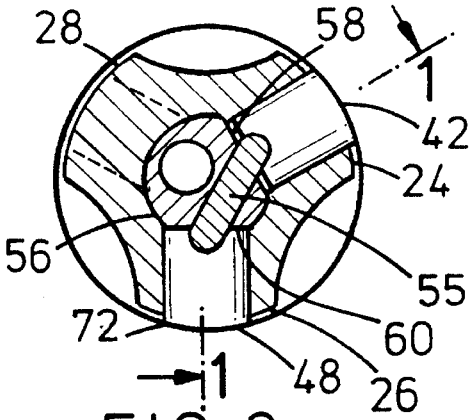
Figure 2B:
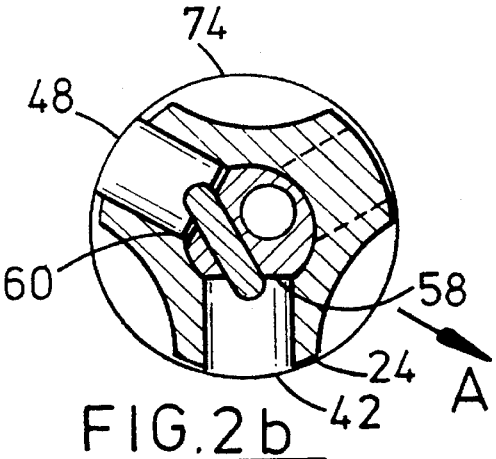
Figure 2C:
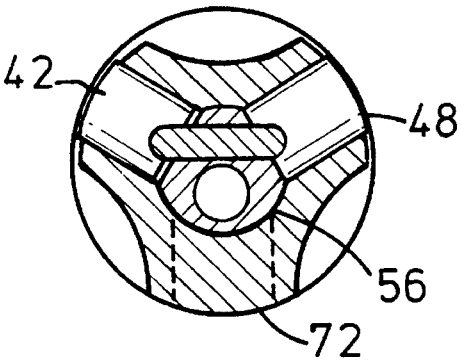
Figure 2D:
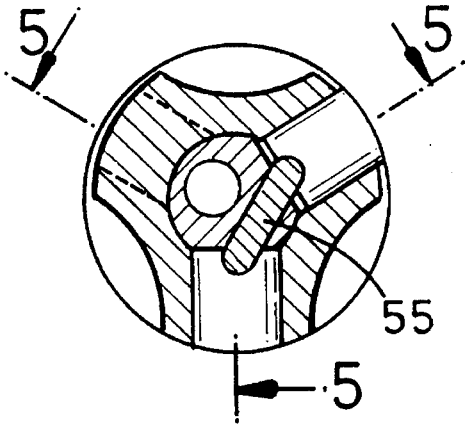
Figure 3:
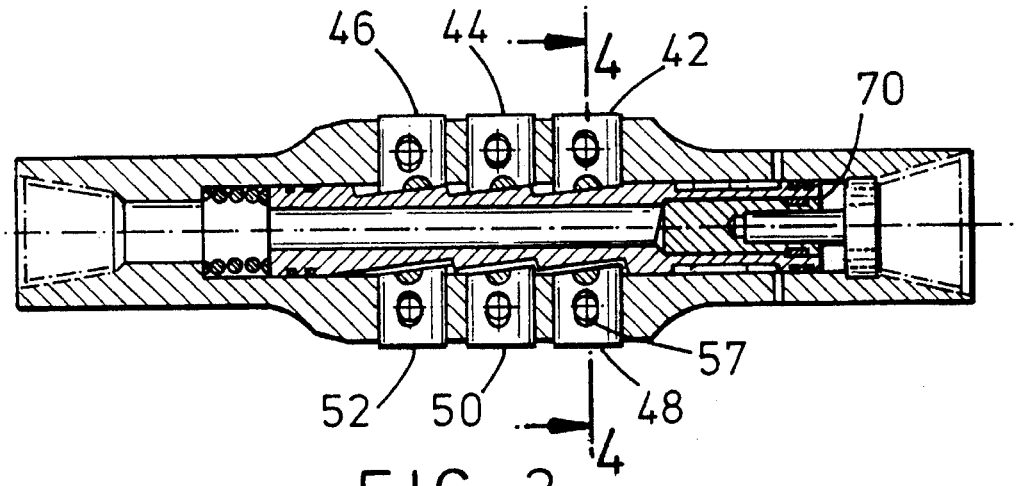
Figure 5:
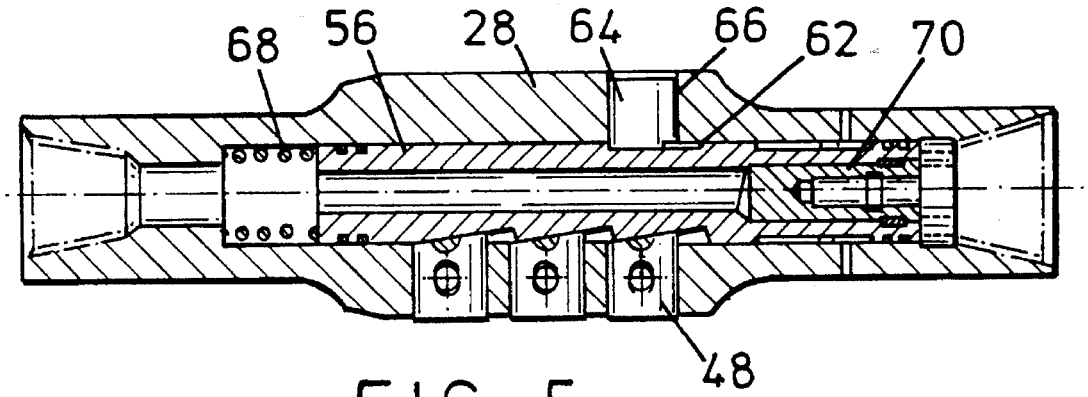
Figure 6:
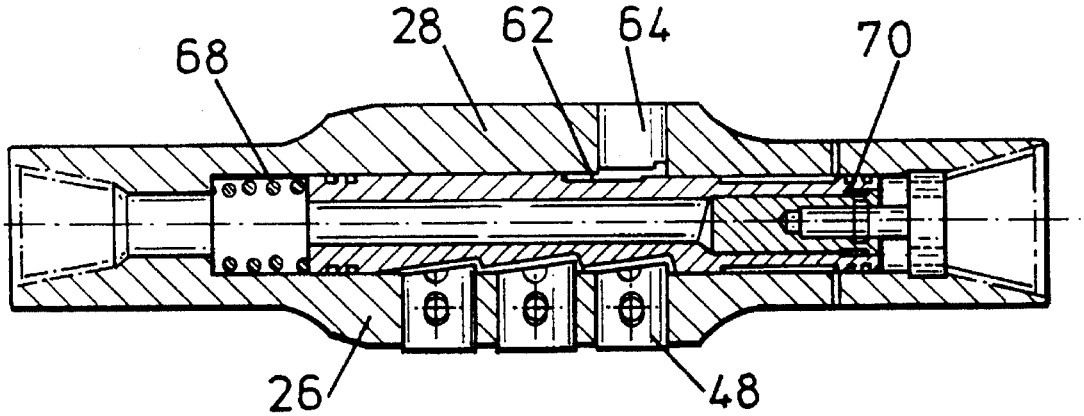

These and other aspects of the present invention will now be described, by way of example, with reference to the accompanying drawings, in which:

FIG. 1 is a longitudinal sectional view of a stabiliser (taken on line 1—1 of FIG. 2*a*) in accordance with a preferred embodiment of the present invention, shown in a first configuration;

FIGS. 2*a*–2*d* are transverse sectional views (showing the complete section) corresponding to line 2—2 of FIG. 1, shown enlarged, and illustrating the positioning of first and second pistons of the stabiliser in successive angular locations during rotation of the stabiliser in a bore;

FIG. 3 is a longitudinal sectional view corresponding to FIG. 1 though showing the stabiliser in a second configuration;

FIGS. *4a–4d* are sectional views of the stabiliser in its second configuration, corresponding to FIGS. *2a– 2d,* on line 4—4 of FIG. 3; and FIGS. 5 and 6 are views corresponding to full longitudinal sections on lines 5—5 and 6—6 of FIGS. *2a– 4a,* respectively, shown somewhat reduced.

Reference is first made to FIG. 1 of the drawings which shows a sectional view of a stabiliser 10 in accordance with one embodiment of the present invention. The stabiliser 10 is adapted to be located in a drill string close to the drill bit. Accordingly, the stabiliser 10 includes an elongate hollow rigid casing 12 having appropriate end connections 14, 16 for joining to adjacent subs and also defines a through passage to permit drilling mud to be pumped through the tool. In FIG. 1, and also FIGS. 3, 5 and 6, the lower end of the tool is shown at the left hand end of the Figure, and thus mud is pumped through the tool from right to left.

The body 12 includes cylindrical end portions 18, 20 and an enlarged generally cylindrical cross-section central portion 22 which defines three angularly spaced longitudinal protrusions 24, 26, 28. One of the protrusions 24 is provided with three longitudinally spaced bores 30, 32, 34 for accommodating extensible and retractable spacer members in the form of pistons 42, 44, 46. A second protrusion 26 is similarly provided with three bores 36, 38, 40 for accommodating extensible and retractable pistons 48, 50, 52. The pistons are retained on the respective bores by pins 54, the ends of which engage the walls of the bores and pass through slotted apertures 57 in the pistons. Each piston in the first protrusion 24 is connected to the adjacent piston in the second protrusion 26 by a connecting rod 55. A single locking piston is provided in the third protrusion 28, as will be described.

The outer ends of the pistons are provided with an appropriate wear resistant finish and appropriate seals (not shown) are provided between the respective pistons and bores.

The pistons are radially movable in the bores, the degree of inward movement being limited by cam means in the form of a hollow control mandrel 56 located within the body 12. The mandrel 56 defines an inclined abutment or camming surface for each piston, the surfaces 58, 60 on each side of the mandrel 56 being of the opposite inclination. The inner ends of the pistons are provided with corresponding abutment surfaces, such that longitudinal movement of the mandrel between a first configuration, as shown in FIGS. 1 and *2a–2d,* and a second configuration, as shown in FIGS. 3 and *4a–4d,* permits the operator to selectively limit movement of one group of pistons 42, 44, 46 in the first protrusion 24 or a second group of pistons 48, 60, 52 in the second protrusion 26.

The mandrel 56 is locked in the first configuration by the interaction of a locking piston and drilling mud pressure, and is locked in the second configuration using drilling mud pressure. If reference is made to FIG. 5 of the drawings, which shows the mandrel 56 in the first configuration, it will be noted that the mandrel 56 includes a surface recess or slot 62 which is in engagement with a locking piston 64 located in a capped bore 66 in the third protrusion 28.

The mandrel 56 is located in an enlarged cross sectional space in the body 12 and is biassed upwardly (from left to right in the drawing) by a spring 68, which acts against the mud pressure, the pressure force being produced by including a restricted cross-section passage 70 at the upper end of the mandrel 56.

To move the mandrel 56 to the second configuration the mud pressure is reduced, allowing the undercut mating edges of the piston 64 and slot 62 to disengage, and the stabiliser is then rotated such that centrifugal force throws the piston 64 outwardly. If the mud pressure is then increased or reapplied the mandrel 56 may be moved past the piston 64 to the second configuration, as shown in FIG. 6. Thus, to lock the stabiliser 10 in the first (right turning) configuration, the mud flow is increased prior to rotation of the tool, while to lock the stabiliser in the second (left turning) configuration the tool is rotated prior to bringing up the mud flow rate.

The operation of the tool will now be described, in a first configuration with reference to FIGS. *2a–2d,* and in a second configuration with reference to FIGS. *4a–4d.*

The protrusions 24, 26, 28 define a diameter, for example 12 inches, slightly smaller than the diameter of the bore being drilled (for example 12¼ inches), and in a median position the pistons 42, 48 (for clarity only two will be described) extend beyond the respective protrusions 24, 26 to define a diameter of 12⅛ inches. In the first configuration (FIGS. *2a–2d*) the camming surfaces 58, 60 of the mandrel are located to permit the first piston 42 to be pushed inwardly of the median position, as shown in FIG. *2b,* but to prevent the second piston 48 from being pushed inwardly of the median position. The connecting rod 55 between the pistons is arranged to push one piston outwardly of the median position if the other piston is pushed inwardly of its respective median position.

As the stabiliser rotates clockwise on a bowed drill string, the stabiliser 10 is pushed against the "lower" wall 72 of the bore 74. In the first configuration, when the second piston 48 is in contact with the lower wall 72 (FIG. *2a*) the piston 48 is pushed hard against the camming surface 60 and, through the connecting rod 55, lifts the first piston 42 clear of the other camming surface 58. Both pistons are in the median position. After a further rotation of 120° (FIG. *2b*) the first piston 42 is brought into contact with the lower wall portion 72 and, due to the position of the camming surface 58, may be pushed inwardly, until the piston 42 is flush with the protrusion 24. This lifts the second piston 48 off the respective camming surface 60 to extend ¼ inch from the protrusion 26 to bear against the adjacent portion of bore wall and thus the extended piston 48 tends to push the stabiliser, and the end of the drill string including the drill bit, in direction "A" towards the opposite wall portion. With further rotation (FIG. *2c*), the pistons 42, 48 return to the median position. Thus, during each rotation of the drill string the second piston 48 is extended as the stabiliser rotates through a selected angular orientation, determined by the relative locations of the pistons 42, 48 and the location of the lower wall 72.

The lateral impulses created on the stabiliser by the extended piston 48 at each rotation of the tool will tend to cause the drill bit to cut towards direction "A", and assuming the bore 74 shown in FIGS. *2a–2d* extends into the page this will result in the bore curving to the right about a vertical axis.

Figure 4A:
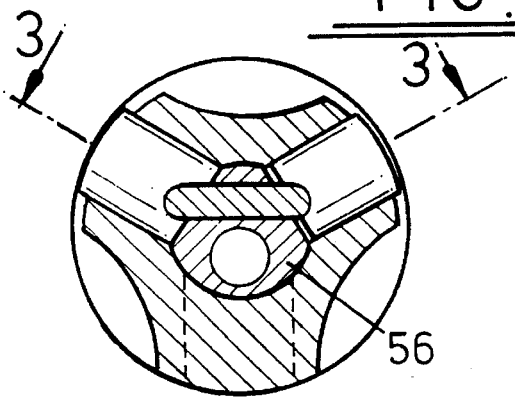
Figure 4B:
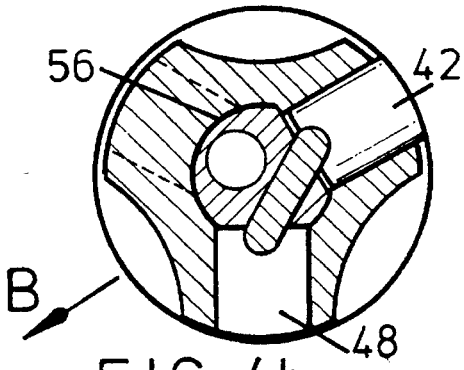
Figure 4C:
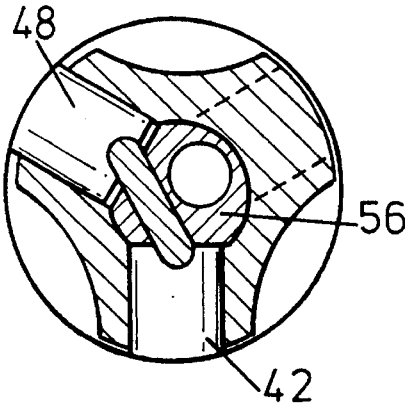
Figure 4D:
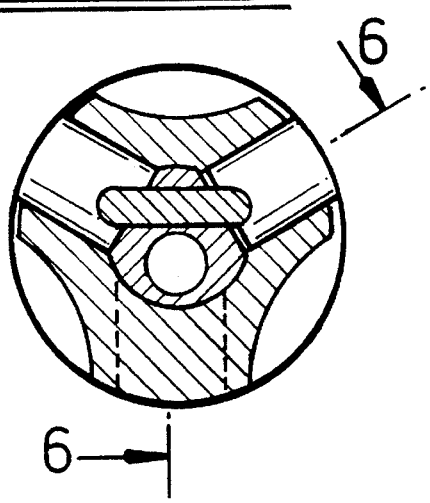

Producing the same effect in the opposite lateral direction "B" (FIG. *4b*) is achieved by locating the mandrel 56 in the second configuration, in which the position the mandrel 56 limits inward movement of the first piston 42 (FIG. *4c*), while allowing the second piston 48 to be pushed inwardly of the median position, and so lift the first piston 52 outwardly of the median position (FIG. 4*b*). This results in a bore which curves to the left as it is drilled.

In use, the stabiliser 10 is placed in a drill string together with a conventional inclination stabiliser, such as described in EP-A-0 251 543, and used to direct drilling of a bore. The inclination stabiliser may be used to alter the course of the bore hole around a horizontal axis, while the stabiliser 10 may be used to alter the course of the bore hole around a vertical axis.

It will be clear to those of skill in the art that the above described embodiment is merely exemplary of the present invention, and that various modifications and improvements may be made to the present invention without departing from the scope of the invention; the tool described above is provided with longitudinally extending protrusions, though spiral protrusions may also be utilised.

I claim:

1. A downhole stabiliser for use in a drill string adjacent the drill bit, the stabiliser comprising:

a hollow and generally cylindrical casing the outer surface of which defines first, second and third angularly spaced protrusions the radially outer surfaces of which define a diameter which is marginally less than the diameter of the bore to be drilled;

said first and second protrusions each carrying radially extensible and retractable spacer members which are interconnected so that radially outward movement of one member results in radially inward movement of the other member and vice versa, effectively to vary the radial length of the respective protrusions; and a control mandrel mounted within the casing and selectively movable between first and second positions, the control mandrel defining abutment means for limiting the inward movement of the spacer members, in the first position the mandrel permitting one spacer member to move radially inwards further than the other, and in the second position the mandrel providing the opposite.

2. The stabiliser of claim 1, in which the spacer members are in the form of pistons each located in a bore in a respective protrusion.

3. The stabiliser of claim 1, in which the third protrusion is of fixed radial length.

4. The stabiliser of claim 1, further including lock means for holding the control mandrel in the respective positions.

5. The stabiliser of claim 4, in which the lock means includes a radially moveable locking piston mounted in the third protrusion for locking the control mandrel in said first position.

6. The stabiliser of claim 5, in which the lock means includes a pressure responsive area on the control mandrel, for responding to fluid pressure in the drill string, pressure applied to said area tending to move the mandrel to the second position.

7. The stabiliser of claim 6 in which a spring is provided between the casing and the control mandrel is biases the mandrel towards the first position.

8. The stabiliser of claim 6 in which said pressure responsive area is in the form of a restricted cross-section passage in the mandrel.

9. The stabiliser of claim 8 in which the locking piston is moveable from a locking position, for engagement with the control mandrel, to an unlocked position by centrifugal force, by rotating the stabiliser.

10. The stabiliser of claim 1, in which the protrusions are angularly spaced by between 90° and 180°.

11. The stabiliser of claim 10, in which the protrusions are equi-angularly spaced by 120°.

12. The stabiliser of claim 1 in which a plurality of sets of spacer members are provided.

13. The stabiliser of claim 12, in which each of said first and second protrusions carries three longitudinally spaced spacer members.

14. The stabiliser of claim 2 in which the pistons are retained in respective bores by pins which engage walls of the bores and pass through slotted apertures in the pistons.

15. The stabiliser of claim 1, in which the spacer member in one protrusion is connected to the spacer member in the other protrusion by a connecting rod.

16. The stabiliser of claim 1 in which the abutment means are in the form of an inclined camming surface for each spacer member, the surfaces on each side of the mandrel being of opposite inclination.

* * * * *

UNITED STATES PATENT AND TRADEMARK OFFICE

CERTIFICATE OF CORRECTION

PATENT NO. : 5,511,627

DATED : April 30, 1996

INVENTOR(S) : Charles A. Anderson

It is certified that error appears in the above-identified patent and that said Letters Patent is hereby corrected as shown below:

On the title page,

Column 2, Foreign Patent Documents, last line, "10/1993" should be -- 3/1993 --.

In the Abstract, line 21, after "drill" insert -- bit --.

Column 2, line 8, "protrusions" should be -- protrusion --.

Column 4, line 57, "impulses" should be -- impulse --.

Column 5, line 1, "52" should be -- 42 --.

Column 6, line 14, "is" should be -- and --.

Signed and Sealed this

Sixth Day of August, 1996

*Attest:*

Bruce Lehman

BRUCE LEHMAN

*Attesting Officer*

*Commissioner of Patents and Trademarks*